United States Patent [19]

Matsuyama et al.

[11] Patent Number: 4,607,838

[45] Date of Patent: Aug. 26, 1986

[54] SHEET SORTER

[75] Inventors: Yoshihiro Matsuyama; Takuma Ishikawa, both of Toyokawa, Japan

[73] Assignee: Minolta Camera Kabushiki Kaisha, Osaka, Japan

[21] Appl. No.: 749,418

[22] Filed: Jun. 27, 1985

[30] Foreign Application Priority Data

Jul. 6, 1984 [JP] Japan ..... 59-102912[U]

[51] Int. Cl.[4] ..... B65H 39/10

[52] U.S. Cl. ..... 271/293; 271/221; 271/294; 271/302; 414/35

[58] Field of Search ..... 271/293, 294, 302, 221, 271/222; 414/35, 36

[56] References Cited

U.S. PATENT DOCUMENTS 3,938,802 2/1976 Hartman ..... 271/293

4,466,608 8/1984 DuBois et al. ..... 271/293

4,478,406 10/1984 Dubois ..... 271/293

*Primary Examiner*—Bruce H. Stoner, Jr.

*Assistant Examiner*—John A. Carroll

*Attorney, Agent, or Firm*—Wenderoth, Lind & Ponack

[57] ABSTRACT

A sheet sorter including: a sheet feed passage having an outlet for feeding sheets one by one in a predetermined direction, and a plurality of bin trays situated adjacent to the outlet and stacked in a pile with gaps between the adjacent bin trays for receiving sheets fed from the passage. The gaps are widened, successively, at an inlet side of the bin trays. The passage is shifted up and down in synchronization with the widened gap so as to align the outlet of passage with the widened gap. A plurality of feed rollers are fixedly mounted on a shaft provided in the outlet for feeding the sheets into the widened gap. Swing plates are rotatably or swingably mounted on the shaft to direct the sheets onto the bin trays.

8 Claims, 4 Drawing Figures

SHEET SORTER

BACKGROUND OF THE INVENTION

1. Field of the Invention

This invention relates to a sheet sorter. More particularly, to a sheet sorter in which printed or typed sheets are fed one by one from a printing or copying machine successively to a plurality of bin trays through a sheet feed passage which is suitably synchronized with the bin trays.

2. Description of the Related Art

A conventional sheet sorter known in the prior art includes a plurality of bin trays situated adjacent to an outlet from which sheets are fed one by one. The bin trays are stacked in a pile with gaps between adjacent bin trays, and the sheets are fed one by one to successive bin trays.

To align the outlet of the sheet feed passage successively with the gap between the adjacent bin trays, two solutions have been proposed, i.e., one in which the sheet feed passage is fixed, while the respective bin trays are shifted up and down, successively, and another in which the sheet feed passage is shiftable up and down, and the bin trays are fixed. Recently, however, a sheet sorter was proposed in which both the sheet feed passage and the stacked bin trays are shiftable in synchronization with each other.

In this kind of sheet sorter, due to the mutual movement of both the sheet feed passage and the bin trays, if a sheet once received in any one of bin trays happens to slip back toward the sheet feed passage, the rear edge of the sheet may, for example, become jammed in the normal sheet feed passage.

To overcome this kind of problem, in a sheet sorter, such as disclosed in U.S. Pat. No. 4,478,406, each of the bin trays has an up-right rear edge substantially perpendicular to a sheet receiving face of the bin tray, so that the sheet once received by the bin tray is prevented from moving backward because the rear edge of the sheet is held by the up-right rear edge portion of the bin tray.

However, this solution is not completely satisfactory, in that, if the sheet fed from the sheet feed passage to the bin tray is curled or electrostatically charged, then the sheet may be placed on the bin tray having a curvature of the sheet caused by feed rollers arranged adjacent to the outlet of the sheet fed passage, and such a sheet may be rolled up by or caught in the feed rollers.

SUMMARY OF THE INVENTION

An object of this invention is to provide a sheet sorter capable of overcoming the disadvantages mentioned above with reference to the related art.

Another object of this invention is to provide a sheet sorter capable of preventing sheets to be sorted from being rolled up by or caught in the feed rollers of the sheet feed passage.

Still another object of this invention is to provide a sheet sorter capable of feeding the sheets in order to bin trays.

According to the present invention, a sheet sorter is provided comprising: means for defining a sheet feed passage having an outlet for feeding sheets one by one is a predetermined direction; a plurality of bin trays situated adjacent to the outlet and stacked in a pile with gaps between the adjacent bin trays for receiving sheets fed from the sheet feed passage; means for widening the gaps, between the adjacent bin trays, successively, at least at an inlet side of the bin trays; means for shifting the sheet feed passage defining means up and down in synchronization with the widening means in such a manner that the outlet of the sheet feed passage is aligned with the widened gap; a transverse shaft rotatably mounted on the sheet feed passage defining means adjacent to the outlet of the sheet feed passage and extending perpendicular to the sheet feeding direction; a plurality of feed rollers spaced from each other and fixedly mounted on the shaft for feeding the sheets into the widened gap; and at least one swing member rotatably or swingably mounted on the shaft at a position or positions between the feed rollers, the swing member comprising an upper portion for rotatably suspending the swing member from the shaft, a lower mass portion for maintaining the position of the swing member due to the force of gravity, and a downstream portion, with respect to the sheet feeding direction, projecting over the feed rollers when viewed from the transverse direction.

DESCRIPTION OF THE PREFERRED EMBODIMENT

Figure 1:
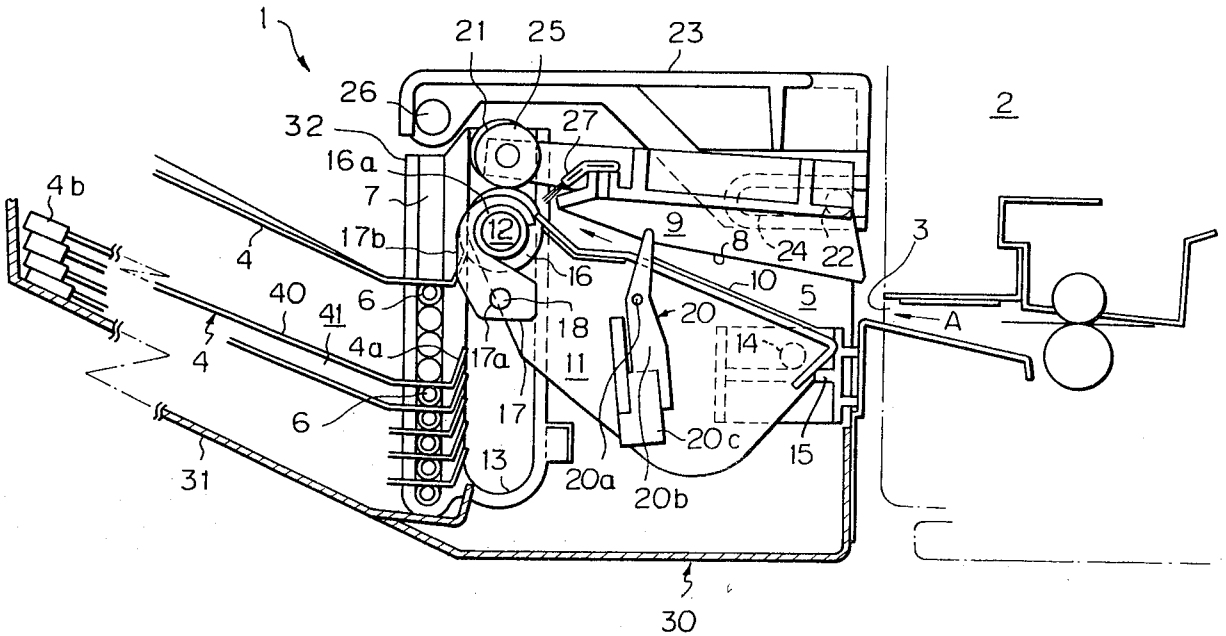
FIG. 1 is a schematic longitudinal elevational view of a sheet sorter according to the present invention.

Referring to FIG. 1, according to the present invention, a sheet sorter generally designated by reference numeral 1 is adapted to be located adjacent to an outlet 3 of a suitable copying or printing machine 2. Copied or printed sheets are discharged one by one from the outlet 3, as shown by an arrow A, and then supplied through a sheet passage 5 in a sheet sorter case 30 successively to a plurality of bin members or trays 4. The bin trays 4 and the sheet passage 5 are adapted to shift up and down, as will be described in detail hereinafter.

Figure 2:
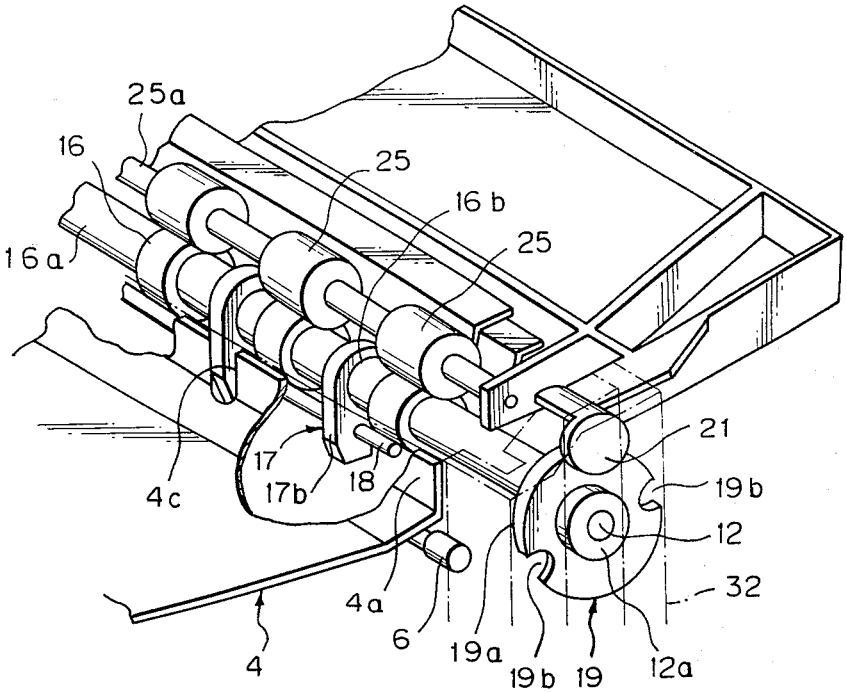
FIG. 2 is a perspective view of a sheet feeding portion of the sheet sorter according to the present invention.

In FIGS. 1 and 2, each of the bin trays 4 has an upward inclined face 40 for supporting thereon a sheet or sheets, a transverse upright edge 4*a* bent upward at an inlet end of the bin tray 4 for holding or stopping the rear edge of a sheet, a pair of trunions 6 projecting transversely outward from the respective side edges at the inlet end of the bin tray 4, and a transverse spacer 4*b* attached to the other end of the bin tray 4.

These bin trays 4 are stacked in a pile at the downstream side of the sheet passage 5 of the sorter 1 in such a manner that each of the trunions 6 is engaged with and vertically guided by a vertical slot 7 of a guide plate 32 fixed to each of the respective side walls of the sheet sorter case 30. These trunions 6 are vertically arranged in line in the vertical slot 7 and in contact with the adjacent trunions 6. The bin trays 4 are accommodated in a bin case 31 attached to the sheet sorter case 30 and are overlapped with each other at the spacers 4*b* in a spacer-to-spacer relationship. Thus, gaps 41 are defined between the respective adjacent bin trays 4 for inserting sheets thereinto.

Figure 3:
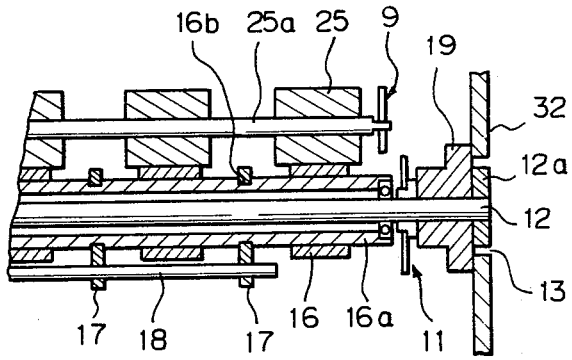
FIG. 3 is a cross-sectional view taken along the roller shafts when seen from above.

In the sheet sorter case 30, an upper unit 9 having a lower sheet guide face 8 and a lower unit 11 having an upper sheet guide face 10 are provided in such a manner that the above-mentioned sheet passage 5 is defined between these sheet guide faces 8 and 10. The lower unit 11 has a pair of pins 14 projecting transversly outward from the respective side edges thereof at the inlet end of the sheet passage 5 adjacent to the outlet 3 of the machine 2. Each of the pins 14 is slidably supported on a horizontal pin guide 15 fixed to the respective side walls of the sheet sorter case 30. At the respective end of each horizontal guide 35, stoppers are provided to limit the sliding movement of the pin 14. The lower unit 11 is provided, at the outlet end thereof, with a transverse shaft 12 rotatably mounted thereon and extending perpendicular to the sheet feeding direction. As shown in FIGS. 2 and 3, a pair of collars 12*a* are rotatably mounted on the respective ends of the shaft 12. Each of the collars 12*a* is engaged with and vertically guided by a vertical U-shaped rail 13 of the guide plate 32 arranged in parallel and adjacent to the vertical slot 7 at an upstream side of the vertical slot 7. Accordingly, the lower unit 11 is supported on the sheet sorter case 30 in such a manner that it is vertically movable at the outlet end of the sheet sorter 1 at the collars 12*a* and horizontally movable at the inlet end of the sheet sorter 1 at the pins 14.

As shown in FIGS. 2 and 3, a hollow cylindrical roller shaft 16*a* is rotatably and coaxially mounted on the above-mentioned shaft 12. This roller shaft 16*a* has a plurality of rollers 16 fixed thereto and spaced from each other in the axial direction. The roller shaft 16*a* is also provided with a plurality of swing plates 17 each arranged between the adjacent rollers 16 and rotatably or swingably suspended from the roller shaft 16*a*.

Each of the swing plates 17 extends perpendicular to the roller shaft 16*a* and includes a substantially U-shaped upper portion which is rotatably engaged with each of the annular grooves 16*b* (FIG. 3) on the hollow roller shaft 16*a* to suspend the swing plate 17 therefrom, as shown in FIG. 1. The upper portion of the swing plate 17 does not project over the upper configuration of the rollers 16, when viewed in the transverse direction, and thus does not disturb the sheet feeding. A lower portion of this swing plate 17 serves as a mass for maintaining the position of this swing plate 17 due to the force of gravity, and is provided with a slot 17*a* through which a rod 18 passes to connect the swing plates 17 in such a manner that the plurality of swing plates 17 are integrally swingable around the roller shaft 16*a*. A downstream portion 17*b* of the swing plate 17 at the left side in FIG. 1 is smoothly continued from the upper portion thereof and slightly projected over the configuration of the feed rollers 16, viewed from the transverse direction, to extend toward the bin tray 4 now in operation. The transverse edge 4*a* of the bin tray 4 is provided with a plurality of openings or notches 4*c* to allow the swing movement of the swing plates 17, as shown in FIG. 2.

Figure 4:
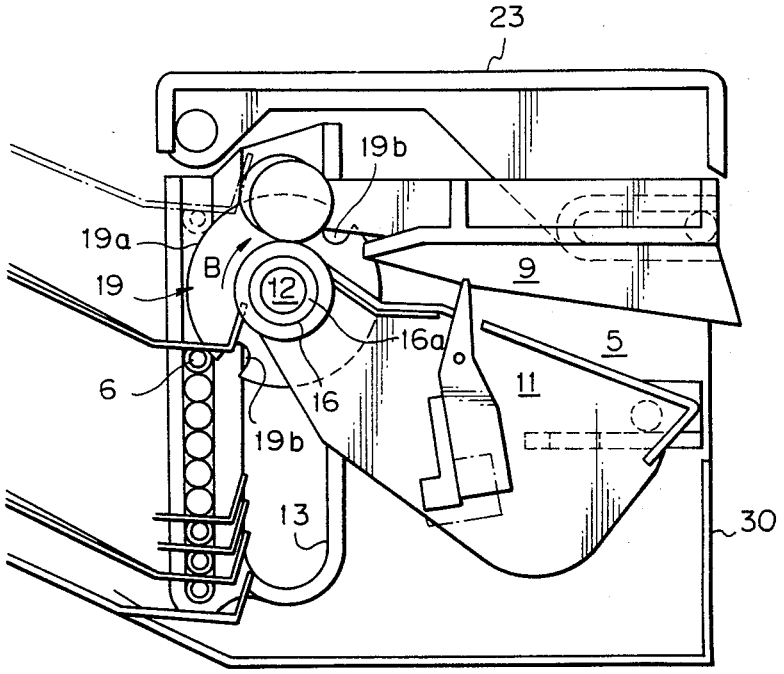
FIG. 4 is a schematic view illustrating mechanisms for shifting up and down both a sheet feed passage and bin trays.

The transverse shaft 12 is provided at the respective ends thereof with Geneva cam wheels 19 rigidly secured thereto, as shown in FIGS. 2, 3 and 4. Each of the cam wheels 19 comprises a circular cam periphery 19*a* and two recesses 19*b* formed on the periphery of the cam and diametrically opposed to each other. A part of the circular periphery 19*a* is positioned on a track of the vertical slot 7, as shown in FIG. 4, in such a manner that it is in contact with the trunions 6 of the adjacent bin trays 4 to widen a gap 41*a* therebetween. At the same time, the lower unit 11 is supported on the trunions 6 vertically arranged in the slot 7 via the cam wheels 19. When the cam wheel 19 is rotated in a direction shown by the arrow B in FIG. 4, the recesses 19*b* are successively brought into engagement with the trunions 6 of the bin trays 4, thus shifting the bin trays 4 up, one by one, from a lower position to an upper position of a widened gap. When the cam wheel 19 is rotated in the opposite direction, the bin trays are lowered, one by one, from the upper position to the lower position of widened gap, in a similar manner.

The shaft 12 of the Geneva cam 19 and the feed roller shaft 16*a* are driven independently by any suitable drive means (not shown) mounted on the lower unit 11. A sheet detecting device 20 is mounted on the lower unit 11. The sheet detecting device 20 comprises an actuator 20*b* rotatably or pivotably mounted on the lower unit 11 by a pivot 20*a*, and a photo sensor 20*c*. If a sheet exists in the passage 5, the actuator 20*b* is pivotably moved, in the counterclockwise direction in FIG. 1, about the pivot 20*a* so that an optical path is opened for the photo sensor 20*c*.

The upper unit 9 has a pair of pins 22 projecting transversely outward from the respective side edges thereof at the inlet end of the sheet feed passage 5 adjacent to the outlet 3 of the machine 2. Each of the pins 22 is slidably supported on a U-shaped horizontal pin guide 24 fixed to each of the respective side walls of a sorter cover 23, which is pivotably mounted on the sheet sorter case 30 at a pivot shaft 26. At the outlet end of the sheet feed pasage 5, the upper unit 9 is provided with a pair of engaging members 21 projecting from the respective side frames thereof. These members 21 are engaged with the above-mentioned respective U-shaped rails 13 in such a manner that they are movable in the vertical direction. Therefore, the upper unit 9 is also supported on the sheet sorter case 30 in such a manner that it is movable vertically at the outlet end of the sheet feed passage 5, at the engaging members 21, and horizontally movable at the inlet end of the sheet feed passage 5 at the pins 22.

As shown in FIG. 2, the upper unit 9 is also provided with a plurality of pinch rollers 25 rotatably mounted on a transverse pinch roller shaft 25*a* extending perpendicular to the sheet feeding direction and arranged inside the engaging members 21 in such a manner that the pinch rollers 25 are in contact with the respective feed rollers 16. Due to the action of gravity on the upper unit 9, the respective pinch rollers 25 are urged against the corresponding feed rollers 16 to define a sheet feeding path therebetween.

As mentioned above, the sorter cover 23 is pivotably mounted on the sheet sorter case 30 about the shaft 26 provided at the outlet side of the sheet passage 5, so that the sorter case 30 can be opened or closed by the cover 23 and the upper unit 9 can also follow the movement of the sorter cover 23, to open the sheet feed passage 5 and allow access thereto.

The upper unit 9 is also provided with an electrostatic cleaner 27 projecting into the sheet passage 5 for removing electrostatic charge from the sheet being fed.

In a sheet sorter 1 as mentioned above, when the Geneva cam wheel 19 rotates in the direction shown by the arrow B in FIG. 4, the lower trunion 6 now in contact with the circular periphery 19*a* is caught by one of the recesses 19*b* and shifted to the upper position of the widened gap, as mentioned above, and at the same time, the Geneva cam wheel 19 moves downward to come into contact with the lower trunion 6 of the next bin tray 4. As this operation is repeated, the bin members 4 are shifted up, one by one, and the widened gaps between the adjacent bin trays 4 and the sheet feed passage 5 are synchronously moved downward.

When the Geneva cam wheel 19 rotates in the opposite direction, the bin trays 4 are shifted down, one by one, and the widened gaps between the adjacent bin trays 4 and the sheet feed passage 5 are synchronously moved upward.

The printed or copied sheets are discharged, one by one, from the outlet 3 of the copying or printing machine 2 and supplied as shown by arrow A in FIG. 1 into the sheet feed passage 5 of the sheet sorter 1. When the front end of the sheet comes into contact with and pivotably moves the actuator 20*b* of the sheet detector 20, the photo sensor 20*c* detects the presence of the sheet and inputs a signal to that effect to a suitable control unit (not shown) so that the pair of Geneva cam wheels 19 rotate by 180° in either direction. Therefore, a widened gap between adjacent bin trays 4 into which the sheet is to be inserted is prepared as mentioned above.

The sheet is then caught by the feed rollers 16 and pinch rollers 25 and forcibly fed into the widened gap between the above mentioned adjacent bin trays. After being released from the pressure between the rollers 16 and 25, the rear end of the sheet falls onto the bin tray 4, while being shifting along the downstream portion 17*b* of each swing plate 17.

Even if the sheet fails to be placed properly on the bin tray 4, due to electrostatic charge on the sheet or for another reason, the rear end of sheet is prevented from being rolled up to the feed rollers 16, because of the presence of the swing plates 17 between the transverse edge 4*a* of the bin tray 4 and the feed rollers 16. In addition, the swing plates 17 are swung around the feed roller shaft 16*a* by the rotation of the feed rollers 16, so that the swing plates 17 tap the rear edge of the sheet and put it in order without trapping the rear end of the sheet. After the sheet is received in the bin tray 4, the next sheets coming through the sheet feed passage 5 are accommodated in the next upper or lower bin trays 4 successively.

We claim:

1. A sheet sorter comprising:

means for defining a sheet feed passage having an outlet for feeding sheets one by one in a predetermined direction;

a plurality of bin trays situated adjacent to said outlet and stacked in a pile with gaps between the adjacent bin trays for receiving sheets fed from said passage;

means for widening said gaps, successively, at least at an inlet side of the bin trays;

means for shifting up and down said passage defining means in synchronization with said widening means so as to align said outlet of the sheet feed passage with the widened gap;

a transverse shaft rotatably mounted on said passage defining means adjacent to said outlet of the sheet feed passage and extending perpendicular to the sheet feeding direction;

a plurality of feed rollers spaced from each other and fixedly mounted on said shaft for feeding the sheets into said widened gap; and at least one swing member rotatably mounted on said shaft at at least one position between said feed rollers, said swing member comprising an upper portion for rotatably suspending said swing member from said shaft, a lower mass portion for maintaining a position of said swing member due to the force of gravity acting thereon, and a downstream portion, with respect to the sheet feeding direction, projecting over said feed rollers when viewed from the transverse direction.

2. A sheet sorter as set forth in claim 1, wherein said swing member consists of a single plate perpendicular to said shaft.

3. A sheet sorter as set forth in claim 2, wherein a plurality of said swing plates are connected therebetween by a rod extending in parallel to said shaft so that said swing plates are integrally swingable.

4. A sheet sorter as set forth in claim 1, wherein said each bin tray has an inlet edge bent upward for holding sheets, which inlet edge has at least one notch so that said at least one swing member is swingable through said notch.

5. A sheet sorter as set forth in claim 1, wherein each said bin tray has a pair of trunions projecting outward from respective sides of the inlet end thereof and spacer means at the opposite end thereof, and said pairs of trunions of said bin trays are guided in lines in a pair of vertical guide means, respectively, of a sorter body, so that said trunions and spacers means define the gaps between the adjacent bin trays when the bin trays are stacked in a pile.

6. A sheet sorter as set forth in claim 5, wherein said passage defining means carries a pair of Geneva cam wheels each having a circular periphery and at least one cam recess on said periphery, each said cam wheel is positioned in such a manner that said circular periphery is in contact with the trunions of the adjacent bin trays so as to widen the gap therebetween and, when said cam wheel rotates, said recess comes into engagement with said trunions of either one of said adjacent bin trays so as to shift said one bin tray up or down and simultaneously to shift down or up, respectively, the said passage defining means to align with the widened gap due to the force of gravity on said passage defining means.

7. A sheet sorter as set forth in claim 6, wherein said pair of Geneva cam wheels are fixed to a second transverse shaft rotatably mounted on said passage defining means, said second shaft is driven independently from said first transverse shaft to which said feed rollers are fixed.

8. A sheet sorter as set forth in claim 7, wherein said first transverse shaft is a hollow cylindrical shaft rotatably and coaxially mounted on said second shaft.

* * * * *